US006641313B2

(12) United States Patent
Bobry

(10) Patent No.: US 6,641,313 B2
(45) Date of Patent: Nov. 4, 2003

(54) MOTION CONTROL FOR MULTIPLE PATH RASTER SCANNED PRINTER

(76) Inventor: Howard H. Bobry, 18416 Olympic View Dr., Edmonds, WA (US) 98020

( * ) Notice: Subject to any disclaimer, the term of this patent is extended or adjusted under 35 U.S.C. 154(b) by 58 days.

(21) Appl. No.: 10/002,069

(22) Filed: Oct. 31, 2001

(65) Prior Publication Data

US 2002/0041783 A1 Apr. 11, 2002

Related U.S. Application Data

(63) Continuation-in-part of application No. 09/444,980, filed on Nov. 22, 1999, now abandoned.

(51) Int. Cl.[7] ..... B41J 3/39
(52) U.S. Cl. ..... 400/88; 400/31
(58) Field of Search ..... 400/88, 31, 691, 400/323; 347/109, 108; 346/143

(56) References Cited

U.S. PATENT DOCUMENTS

| | | | | |
|---|---|---|---|---|
| 3,867,882 A | | 2/1975 | Ahlgren et al. | |
| 3,960,072 A | | 6/1976 | Ahlgren et al. | |
| 4,089,262 A | * | 5/1978 | Sopora | 101/4 |
| 4,277,186 A | | 7/1981 | Takahashi | |
| 4,545,695 A | | 10/1985 | Agata | |
| 5,063,451 A | | 11/1991 | Yanagisawa et al. | |
| 5,229,827 A | | 7/1993 | Sato et al. | |
| 5,634,730 A | * | 6/1997 | Bobry | 400/88 |
| 5,685,651 A | | 11/1997 | Hayman et al. | |
| 6,116,707 A | | 9/2000 | Avida | |

FOREIGN PATENT DOCUMENTS

| | | |
|---|---|---|
| EP | 0 449 157 A1 | 10/1991 |
| EP | 0 598 251 A1 | 5/1994 |

OTHER PUBLICATIONS

Niels J. Nielsen, History of ThinkJet Printhead Development, Hewlett–Packard Journal, May 1985, pp. 4–11.
LabelWriter XL Technical Manual, CoStar Corporation, Greenwich, CT, Jan. 1997, pp. 1–12.

* cited by examiner

*Primary Examiner*—Anthony A. Nguyen
(74) *Attorney, Agent, or Firm*—Rankin, Hill, Porter & Clark LLP

(57) ABSTRACT

A printing device for printing text, indicia, and images on a medium includes a housing that abuts a surface of the medium during a printing sequence and includes a print head which is moved from a starting position to an ending position during a printing sequence by a bidirectional first movement drive in cooperation with a second bidirectional movement drive. Control means disposed in the housing include motion control means for controlling said movement drives and reset means to prepare the printer for a subsequent print sequence.

20 Claims, 13 Drawing Sheets

MOTION CONTROL FOR MULTIPLE PATH RASTER SCANNED PRINTER

This application is a continuation-in-part of application Ser. No. 09/444,980, filed Nov. 22, 1999 which is now abandoned.

BACKGROUND OF THE INVENTION

The invention relates generally to methods and apparatus for printing and recording text, indicia, images, and other information on a medium such as paper, for example. More particularly, the invention relates to print head motion control for a printing apparatus comprising a housing which is manually positioned adjacent to a surface of the print medium, said housing remaining stationary with respect to the medium while printing is accomplished by raster scanning of a print head over multiple paths within the housing.

Two distinct methods of generating images for display or printing are well known. The term raster scanning refers generally to the process of generating an image as a series of rows and columns of pixels, or individual image elements, as is familiar from its use in generating television pictures, for example, or as is used in dot matrix or ink jet printers as are well known. This contrasts with the generation of an image by vectors, also known as vector graphics, where an image is generated by drawing lines comprising the image one line at a time, from point to point, as would be done manually with a pencil, for example, or as may be done by a plotter as is well known.

Various types of printing devices have been disclosed with the objective of printing on the surface of a medium external to a print apparatus held stationary on the medium. U.S. Pat. No. 4,089,262, awarded to Sopora, discloses a printing mechanism wherein the marking device " . . . follows the contours of the characters to be printed . . .", hence it generates an image via the vector graphics method. This method inherently requires that the print head be movable in a multiplicity of directions such that characters can be drawn, and requires complex control mechanisms and algorithms.

Generally the raster scan method offers a number of advantages over the vector method of generating an image. The print head is scanned over the print area in an ordered, known manner, regardless of the content of the image. This simplifies control, and will in general result in faster printing than the vector method, where each and every line of the image must be individually drawn.

U.S. Pat. No. 5,634,730, awarded to the present applicant, Bobry, discloses a printing mechanism, as a portion of a printing apparatus, wherein a print head generates a raster scan image as a series of columns of pixels laid down as the print head moves on a single path over the surface of the print medium, as the head travels from a starting position of the path to an ending position of the path; and/or on the return pass of the head over the same path, as the head is returned from the ending position to the starting position. This single path raster scan printing mechanism offers the advantages of fast printing and simple control, but is limited in the size of the image which can be printed. One dimension of the image is limited to the image swath of the print head.

European patent application number EP 0 449 157 A1, filed by Damiano; European patent application number EP 0 598 2251 A1, filed by Wolf; and U.S. Pat. No. 5,685,651, awarded to Hayman et al., all disclose printing mechanisms wherein a print head passes over the surface of the print medium on multiple paths so as to generate a raster scan image. Such multiple path raster scan printing mechanisms are advantageous in a number of applications because they allow the printing of larger images than the single path mechanism, albeit with a sacrifice in speed, but nonetheless at a much higher printing speed than allowed by the vector method.

It is desirable for a printer incorporating a multiple path raster scan printing mechanism to be interoperable with an external apparatus which provides the information to be printed, such as a personal computer, for example, via the use of a conventional printer interface as is well known. Preferably, the printer is operable with a personal computer through the use of the commands and physical connection means which have become widely used and well known for purposes of operating conventional desk top printers with personal computers. Such connection means include, for example, cable connections to parallel, serial, or USB computer ports; or wireless connections via optical (infra red) or radio frequency means as are well known.

It has been acknowledged in the prior art that such interoperability between a printer and a personal computer requires that the printer incorporate control circuitry which functions to communicate with the computer, and interpret the data and instructions received, as well as to command the printer's print head and movement drives to accomplish the desired printing function. It has not, however, been previously recognized that such control circuitry, when used in a printer incorporating a multiple path raster scan printing mechanism, must operate in a significantly different manner from that in a conventional desk top printer. To wit, the conventional desk top printer incorporates a first movement drive which moves the print head back and forth, or bidirectionally, across the surface of the print medium, and a second movement drive which advances the print medium with respect to the print head in one direction only, i.e. unidirectionally, whether such advance is a single line advance to allow for the printing of an additional line, or a multiple line advance, or form feed, for the purpose of readying the printer to print a new image, or to continue an image or print job on a subsequent page. The multiple path raster scan printers anticipated in the prior art likewise incorporate a first movement drive which moves the head bidirectionally, but unanticipated is the fact that the second movement drive must be bidirectional, not unidirectional. If a unidirectional drive were used, the printer mechanism would be advanced, printing one line at a time, until the second movement drive reached the end of its travel. At that point, with unidirectional drive capability only, printing would have to cease, there being no means to return the second movement drive to its starting position to print another image. Merely making the second movement drive bidirectional is insufficient, however, as control means must be provided within the printing device to carry out the reset operation autonomously upon completion of the print job, that is, without the receipt of additional instructions from the host computer.

Alternatively, means can be provided for the operator to manually reset the printer mechanism to its starting position prior to starting the next print job, or means can be provided to reset the printer mechanism using energy stored during the previous print job. As a further alternative, a new type of multiple path raster scan printer mechanism is disclosed in which the motion of the print head is inherently cyclical, even with the use of a unidirectional motor drive, with the result that the position of the print head at the end of a print job corresponds with the starting point of the next print job.

It is the objective of the present invention, therefore, to provide methods and apparatus for control of print head motion in a multiple path raster scan printer, including means for reset of the printer in preparation for a subsequent print job.

SUMMARY OF THE INVENTION

To the accomplishment of the foregoing objectives, the present invention contemplates, in one embodiment, a multiple path raster scan printer wherein a first movement drive comprises a bidirectional motor drive, and a second movement drive comprises a unidirectional motor drive in combination with means for an operator to manually restore said drive to a starting position after completion of a printing operation. A second embodiment contemplates a multiple path raster scan printer wherein a first movement drive comprises a bidirectional motor drive, and a second movement drive comprises a unidirectional motor drive in combination with means to restore said drive to a starting position after completion of a printing operation using energy stored, during said printing operation, in an element such as a spring. A third embodiment contemplates a multiple path raster scan printer wherein a first movement drive comprises a bidirectional motor drive, and a second movement drive comprises a bidirectional motor drive, and further comprises a controller such that said drives are electrically restored to a starting position after completion of a printing operation. A fourth embodiment contemplates a multiple path raster scan printer wherein a first movement drive comprises a bidirectional motor drive, and a second movement drive comprises a bidirectional motor drive, and further comprises a controller such that said drives are reversed after completion of a printing operation so that the position of the print head at the completion of the printing operation becomes the starting position for the next printing operation. A fifth embodiment contemplates a multiple path raster scan printer wherein a first movement drive comprises a bidirectional motor drive, and a second movement drive comprises a unidirectional motor drive coupled to a cyclically bidirectional drive mechanism.

DETAILED DESCRIPTION OF THE INVENTION

Figure 1:
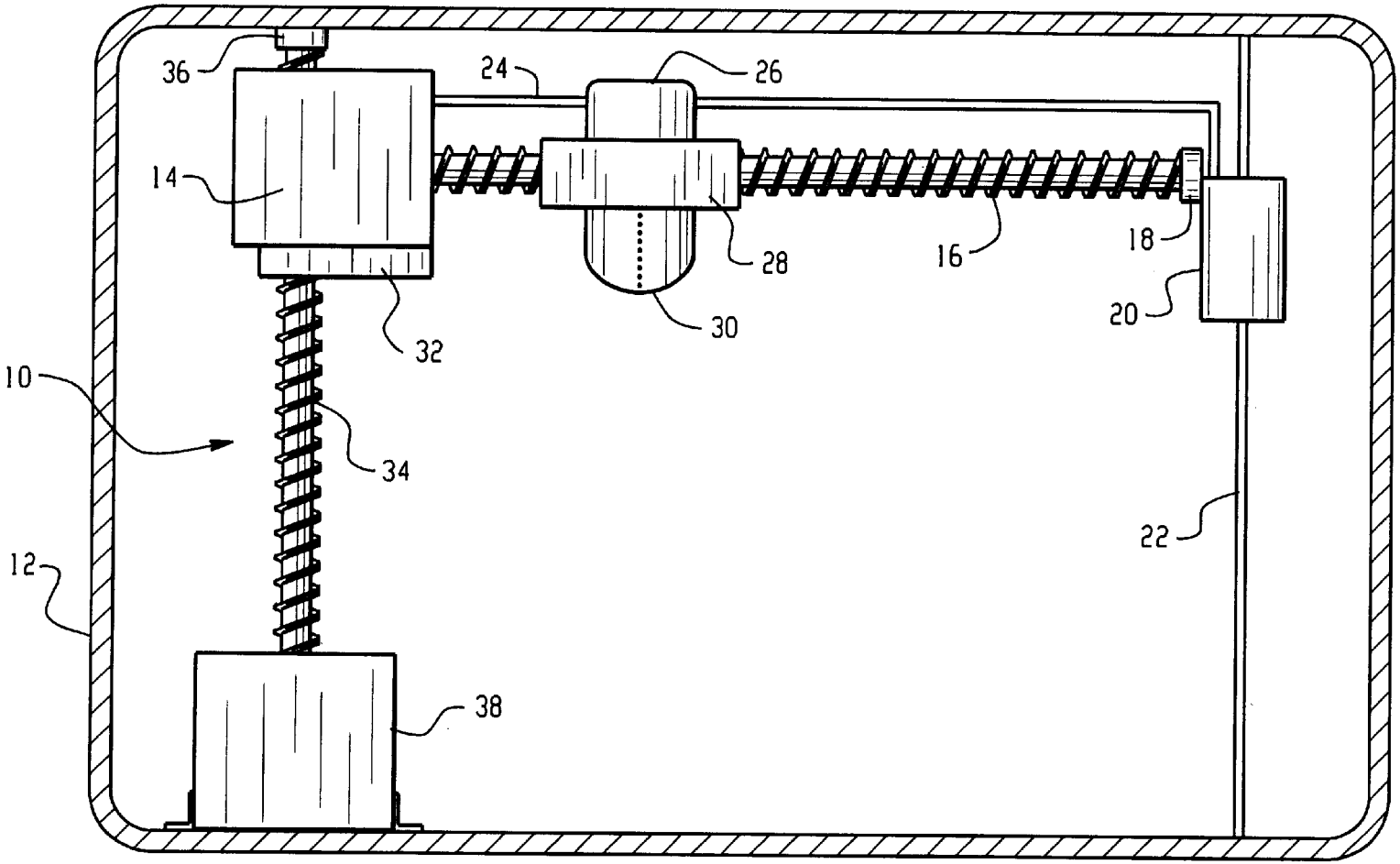
Fig. 1 PRIOR ART
FIG. 1 is a simplified schematic diagram of a multiple path raster scan printer mechanism according to the prior art.

With reference to FIG. 1, a simplified schematic diagram of a multiple path raster scan printer mechanism according to the prior art is shown as viewed from the bottom, i.e. as would be seen from the surface of the print medium. The mechanism 10, comprises a housing 12, which abuts the surface of the print medium, and to which other components are mounted. An electronic controller (not shown) comprises a microprocessor for controlling movement of a first movement drive and generating signals to control the print head, as well as interface means for connecting the printer to the host computer.

A first movement drive comprises a motor 14, a lead screw 16, and a nut 28. The lead screw is coupled to the motor at one end, while the other end of the screw is supported by bearing 18, which is supported by bushing 20 and support 22. An ink jet print head 30 is mounted on the nut 28, as is a bushing 26 which travels along a support 24 which may suitably be a rod or rail. As the screw is rotated by the motor, the nut carries the ink jet head along the length of the screw. The bushing and support cooperate to prevent rotation of the nut about the screw. As is the case in conventional desk top printers which comprise a movable print head, such as dot matrix and ink jet printers, the motor 14 is part of a bidirectional motor drive such that the nut, and thus the ink jet print head, may be driven back and forth along the screw, and thus back and forth over the surface of the print medium.

A second movement drive comprises nut 32, lead screw 34, bearing 36, and motor 38. The first movement drive's motor 14 is mounted on nut 32, such that the entire first movement drive as described above may be moved along screw 34 in response to rotation of the screw powered by motor 38. The bushing 20 is free to slide along support 22. This second movement drive is thus analogous in function to the paper feed drive of a conventional desk top printer, as recognized by the prior art. Typically, each traverse of the print head 30 to print a line will be followed by a movement of the second movement drive, repositioning the entire first movement drive mechanism such that another traverse of the print head will print the next line. This process is repeated until either the complete image has been printed, or until the end of travel of the second movement drive is reached, i.e. with reference to FIG. 1, nut 32 abuts motor 38 and no further travel is possible. No analogous circumstance occurs in a conventional desk top printer, as continuous advances of the paper feed drive are not only possible, but are in fact routinely carried out to accomplish ejection of the completed page and printing of subsequent images on subsequent pages.

For this reason, the motion control methods and apparatus of conventional desk top printers are unsuitable for use with multiple path raster scanned printers as disclosed in the prior art. It will be further recognized that while FIG. 1 is an exemplary description of the prior art using screw drives, the same fundamental operations and limitations are present with alternative drive means such as, for example, belt, gear, or chain drives.

In order to properly control the multiple path raster scan printer, it is necessary to reliably determine when the movement drives have reached the end of their allowable travel. Note that in a conventional desk top printer, there is no such determination to be made, as there is no corresponding limit to travel. Note also that this end of travel determination (EOT) is fundamentally different from either an end of file, end of page, or form feed command as may be received from the computer to which the printer is connected. The latter commands may be useful as signals that the end of the image has been reached, but that condition may or may not coincide with EOT, and in fact generally will not. Whereas printing can continue beyond the end of a page in a conventional printer, with the print image continuing on a subsequent page, a printer of the type described herein is mechanically constrained to stop printing upon reaching EOT, whether the complete image desired has been printed or not. It is therefore a requirement to sense when EOT has occurred for purposes of stopping printing and resetting the print mechanism to enable the printer to print a subsequent print job.

It will be recognized that many means of sensing EOT are available. Assume, for example, with reference to FIG. 1, that printing takes place as the print head traverses from left to right, and as the first movement drive mechanism is advanced downward by the second movement drive. Printing will thus start at the upper left corner, and finish (EOT) at the lower right corner. Any of a number of sensing devices, such as switches, photo cells, magnetic reed switches, and so forth, may be used to sense that the print head has traveled to the EOT position. In addition, use may be made of position information, used for control of the print head, for determination that EOT has been reached. It will be necessary for the print head control circuit to monitor the position of the print head at all times so that the print head may be controlled to print the image properly. This position information may come from position encoders which report either the progress of the movement drives, or the rotation of the motors, for example. A suitable encoder for this purpose is Hewlett-Packard device HEDR-8000, which will produce output pulses indicative of rotation. If the motors are stepper motors, which advance by a known degree of rotation for each drive pulse applied, then it is possible to determine the print head position simply by keeping a running count of the number of drive pulses delivered to each motor. For purposes of determining that EOT has been reached, it is only necessary to compare the number of drive pulse counts applied to the number counts which corresponds to travel to EOT. Assume that the number of drive pulses applied to first movement drive motor 14 for each line of print is Nx, and that the number of drive pulses applied to second movement drive motor 38, to position the mechanism to print the last possible line, is Ny. When Nx drive pulses have been applied to the first movement drive motor 14, after Ny drive pulses have been applied to the second drive motor 38, then it is known that the end of travel, EOT, has been reached. This may also be readily determined by counting only the number of drive pulses applied to the first movement drive motor, since it will be recognized that EOT is reached when a total pulse count which is the product of Nx and Ny (Nx*Ny) is achieved. This is illustrated as a flow chart in FIG. 2.

Figure 2:
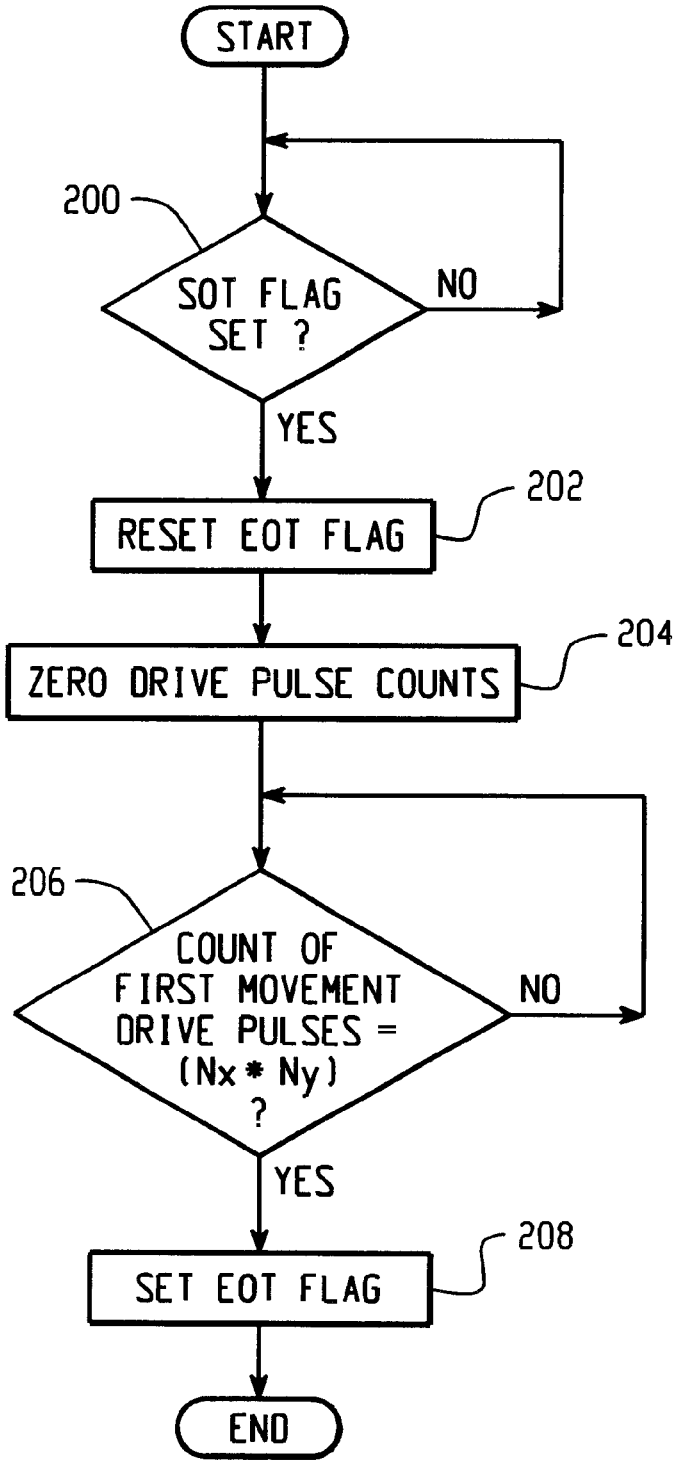
FIG. 2 is a flow chart of an exemplary control sequence to determine when the movement drives have reached end of travel.

Referring to FIG. 2, at step 200 a signal or logic flag is tested to determine if the printer mechanism has been reset to the start of travel, or SOT. This signal may come from a sensing switch, photo cell, magnetic sensor, or other device similar to that described earlier for the purpose of sensing EOT. At steps 202 and 204 the control circuit is initialized. This will include resetting any EOT signal or flag set as the result of a previous printing operation, as well as resetting the drive pulse counts to zero. At 206 the count of drive pulses applied to the first movement drive is compared with the product of Nx and Ny. If this count has not been achieved, a control loop is executed continuously retesting this count until it does equal the product of Nx and Ny. Then, at 208, a logic flag is set to indicate that EOT has been reached. This EOT flag causes printing to be stopped, as will be further described. While FIG. 2 has been described in terms of drive pulse counts, it will be recognized that essentially the same function may be achieved by counting pulses supplied by position encoders as previously described.

Figure 3:
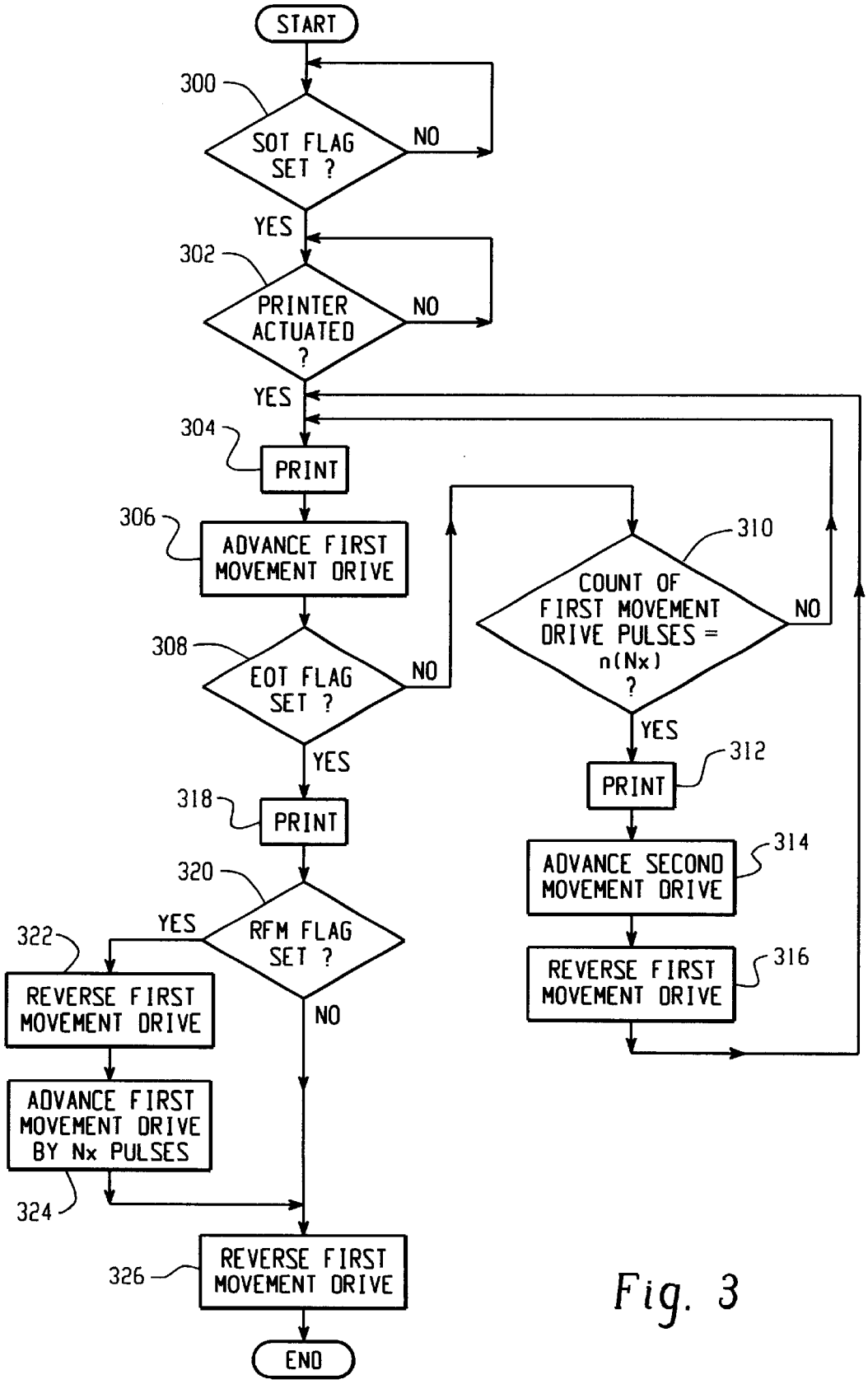
FIG. 3 is a flow chart of an exemplary control sequence for a printing operation in accordance with the invention for embodiments wherein the second movement drive comprises a unidirectional motor drive.

Referring to FIG. 3, a flow chart is shown of an exemplary control sequence for a multiple path raster scan printer wherein the second movement drive is a unidirectional motor drive. At 300 the start of travel, or SOT, flag is tested to determine if the printer mechanism has been reset to the start, or home, position. If so, the status of printer actuation is tested at 302. Typically, this type of printer is manually actuated by the user to initiate printing by pushing a button, for example. If the printer has been actuated, control flow proceeds to 304, where a print command is issued to fire the print head as required to print the portion of the desired image which can be printed at the present print head position. At 306 the print head position is advanced to the next print position by the first movement drive. The EOT flag, which would be set according to the flow chart of FIG. 2, is tested at 308. If the EOT flag is not set, a test of the count of first movement drive pulses takes place at 310. This count is tested to see if it equals some integral multiple, n, of Nx, where n=1,2,3 . . . This happens only when the print head has reached the end of a print line. If this condition has not been satisfied, control loops back to 304, where another print command is issued. If the print head has reached the end of a print line, control flow proceeds first to 312, where another print command is issued, followed by an advance of the second movement drive at 314, and then a reversal of the first movement drive at 316, thence a loop back to another print command at 304. This loop continues to run until the EOT flag is found to be set at step 308. In that case, flow continues to step 318, where another, final, print command is issued. At 320 the RFM flag is tested. The RFM, or return first movement, flag, is a logic flag which indicates whether or not the first movement drive must be driven back to its start position in order to reset the printer to the SOT position. This will be dependent upon the design of the printer, and more specifically it will be dependent upon the number of lines, or traverses of the first movement drive, and the direction of those traverses, comprising a complete image. In the previously described example wherein SOT is at the upper left corner, and EOT is at the lower right corner, then the RFM flag would be set, indicating that the first movement drive must be reversed and driven back to the starting position, i.e. back to the left. If the EOT position were at the lower left, on the other hand, then the RFM flag would not be set. Because the status of the RFM flag is a function of the design of the printer, this flag could be permanently placed in the set or reset condition at the time of manufacture. If the RFM flag is found to be set, control flow proceeds to step 322, where the first movement drive is reversed, and then proceeds to step 324, where the first movement drive is advanced by Nx drive pulses. This results in a full traverse of the first movement drive. Finally, the first movement drive is again reversed at step 326, so that it will be ready for the next print operation. In this manner printing proceeds line by line, with the bidirectional first movement drive being reversed at the completion of each line, until the print mechanism reaches the end of travel (EOT), at which point the printing sequence is ended.

Figure 4:
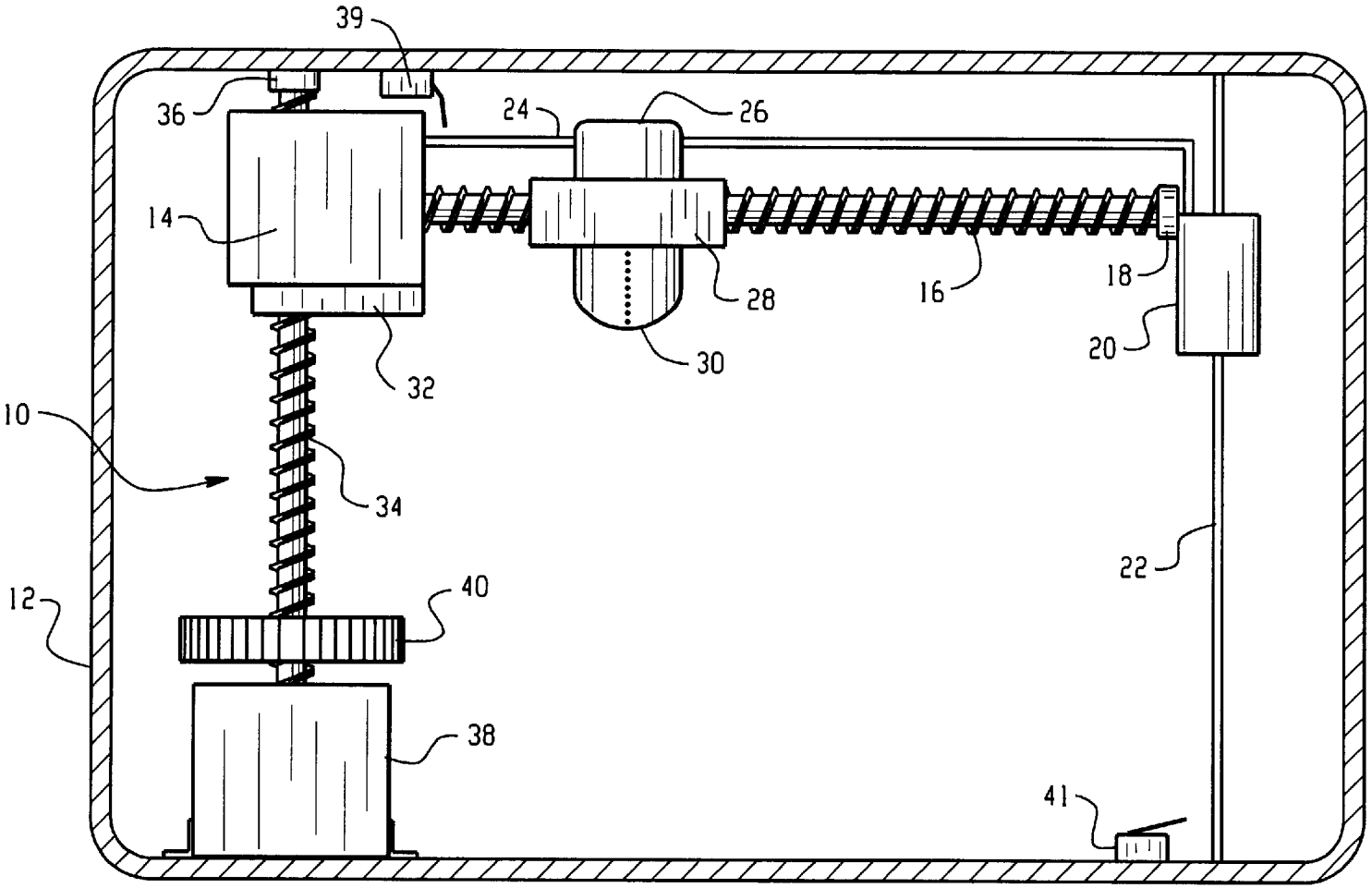
FIG. 4 is a simplified schematic diagram of a multiple path raster scan printer mechanism incorporating manual reset means.

FIG. 4 illustrates a multiple path raster scan printer mechanism suitable for use with the control sequence described in reference to FIG. 3. Shown is a manually resettable printer mechanism similar to that shown in FIG. 1, but with the addition of a contact switch 39 for sensing that the print head is in the SOT position, a contact switch 41 for sensing that the print head is in the EOT position and a thumb wheel 40 attached to screw 34. The thumb wheel would be of such a size that it protrudes through the top surface of the printer housing and is usable by the operator to restore the printer mechanism to the initial, or SOT, position. Upon completion of a first printing operation, a subsequent printing operation is enabled by manual reset of the printer mechanism as described herein.

Figure 5:
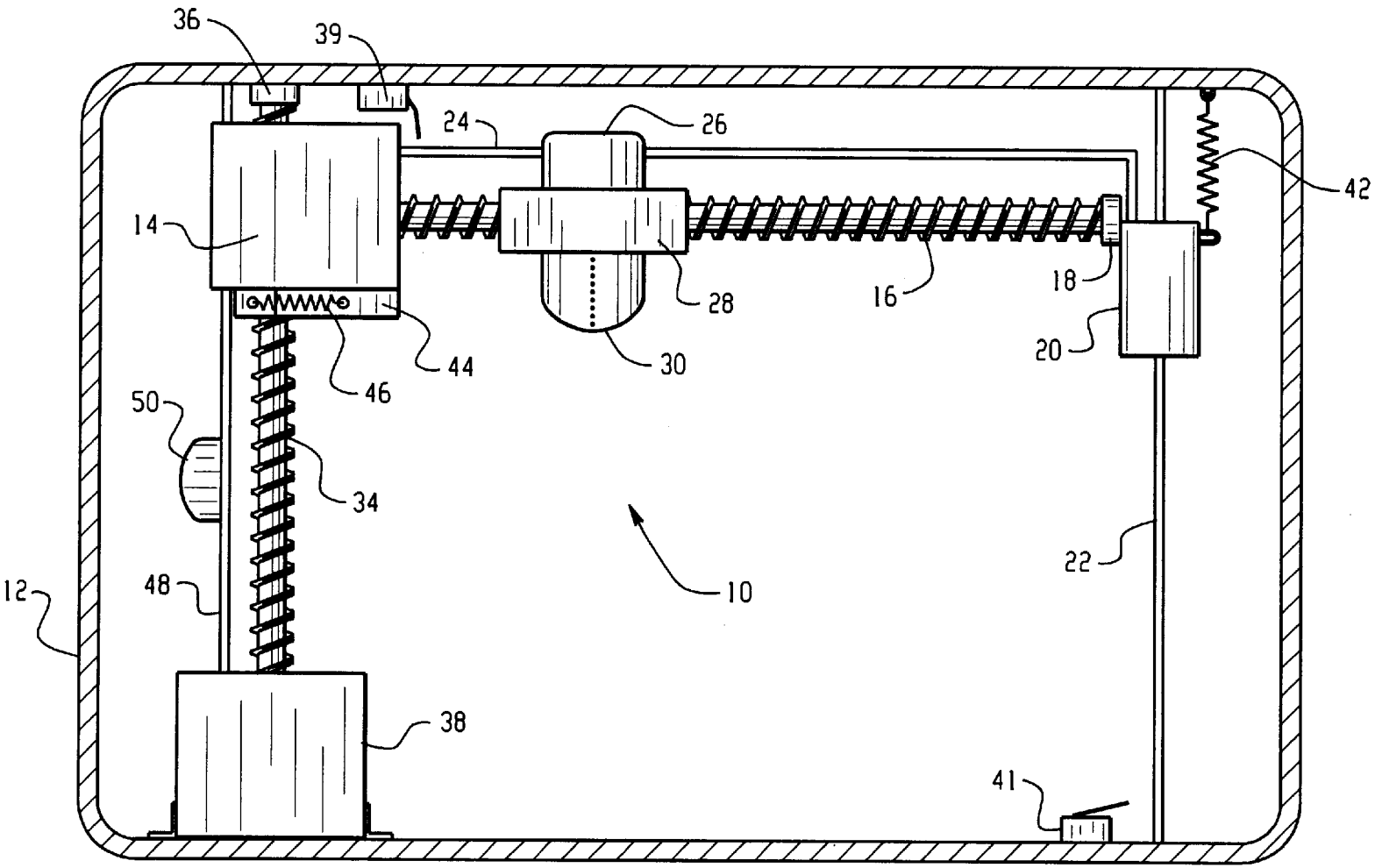
FIG. 5 is a simplified schematic diagram of a multiple path raster scan printer mechanism incorporating a stored energy reset means.

FIG. 5 illustrates another multiple path raster scan printer mechanism suitable for use with the control sequence of FIG. 3. Shown is a printer mechanism similar to that of FIG. 1, but which is reset using energy stored during a printing sequence. Specifically, nut 32 of FIG. 1 has been replaced by a split nut 44 which is normally held closed by spring 46. Spring 42 is connected between bushing 20 and the housing 12, such that spring 42 is charged by advance of the print mechanism during a printing sequence. One portion of the split nut 44 rides along a rail or rod 48, which extends along the path of the nut's movement. A handle 50 is connected to rod 48 such that a user may depress the handle and open the nut 44, overcoming the closure force applied by spring 46. When this happens the nut will slide freely over screw 34 and the print mechanism will be restored to the SOT position by the release of energy stored in the spring 42. The handle 50 may be beneficially combined with an electrical switch for actuation of the printer. A brief time delay may be built in to the actuation sequence to allow time for the mechanism to be reset to the SOT position. In this manner, the operator would simply depress the handle 50 when a print is desired. The mechanism would be reset to the start position using energy stored during the previous printing operation, and printing of the next image would commence. As was described with reference to FIG. 4, contact switches 39 and 41 sense the presence of the print head in the SOT and EOT positions respectively.

Figure 6:
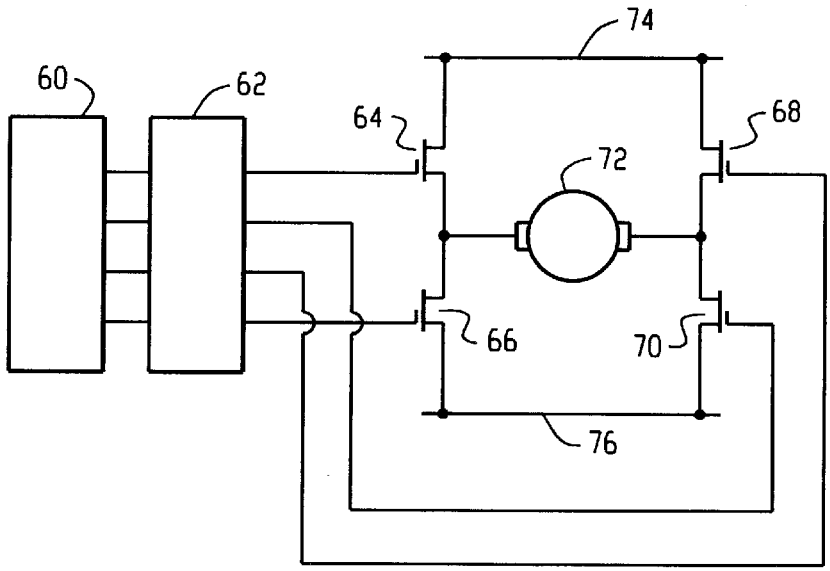
FIG. 6 is a simplified schematic diagram of a control and drive circuit for embodiments wherein the second movement drive comprises a bidirectional motor drive, where said motor is a dc motor.

Shown in FIG. 6 is a simplified schematic diagram of a control and drive circuit for a bidirectional motor drive, where the motor is a dc motor such as a permanent magnet dc motor. A controller 60 (most typically a microprocessor) provides motor drive signals to a drive circuit 62 which provides buffer and level shifting functions so as to drive transistors 64, 66, 68, and 70. While these transistors are shown as metal oxide field effect transistors (MOSFETs), it will be appreciated by those versed in the art that other types of suitable devices, such as bipolar transistors, may be used. When the motor is being advanced in a single direction, a single pair of diagonally opposite transistors is turned on, such as, for example, transistors 64 and 70. This will result in application of power across the terminals of motor 72 from the power supply rails 74 and 76. When the motor drive is to be reversed, transistors 64 and 70 are turned off, and transistors 66 and 68 are turned on, thus reversing the voltage applied across the motor.

Figure 7:
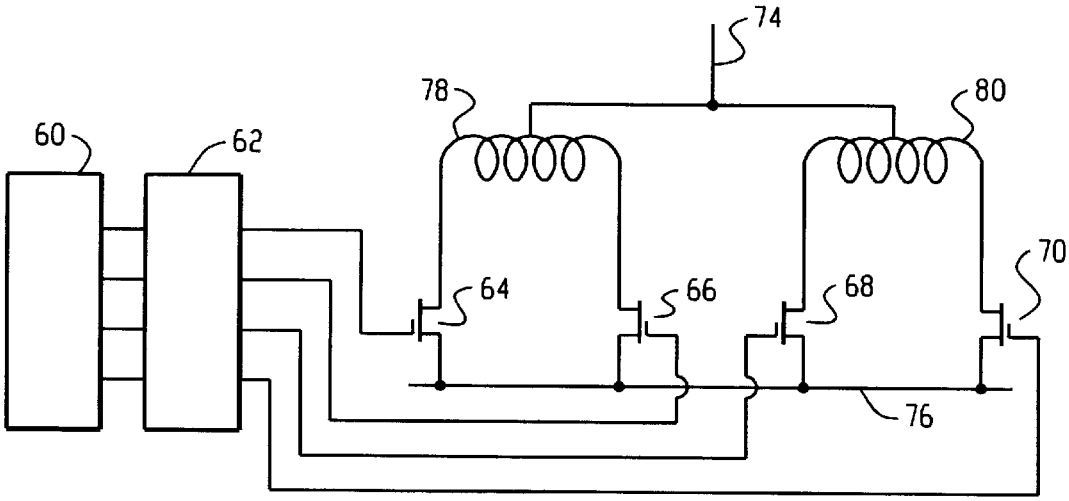
FIG. 7 is a simplified schematic diagram of a control and drive circuit for embodiments wherein the second movement drive comprises a bidirectional motor drive, where said motor is a stepper motor.

Shown in FIG. 7 is a simplified schematic diagram of a control and drive circuit for a bidirectional motor drive, where the motor is a stepper motor. As in FIG. 6, a controller 60 provides motor drive signals to a drive circuit 62. The stepper motor is comprised of two windings 78 and 80, and directional control of the stepper motor is determined by the sequence in which drive signals are applied to the two motor windings, as is well known.

Figure 8A:
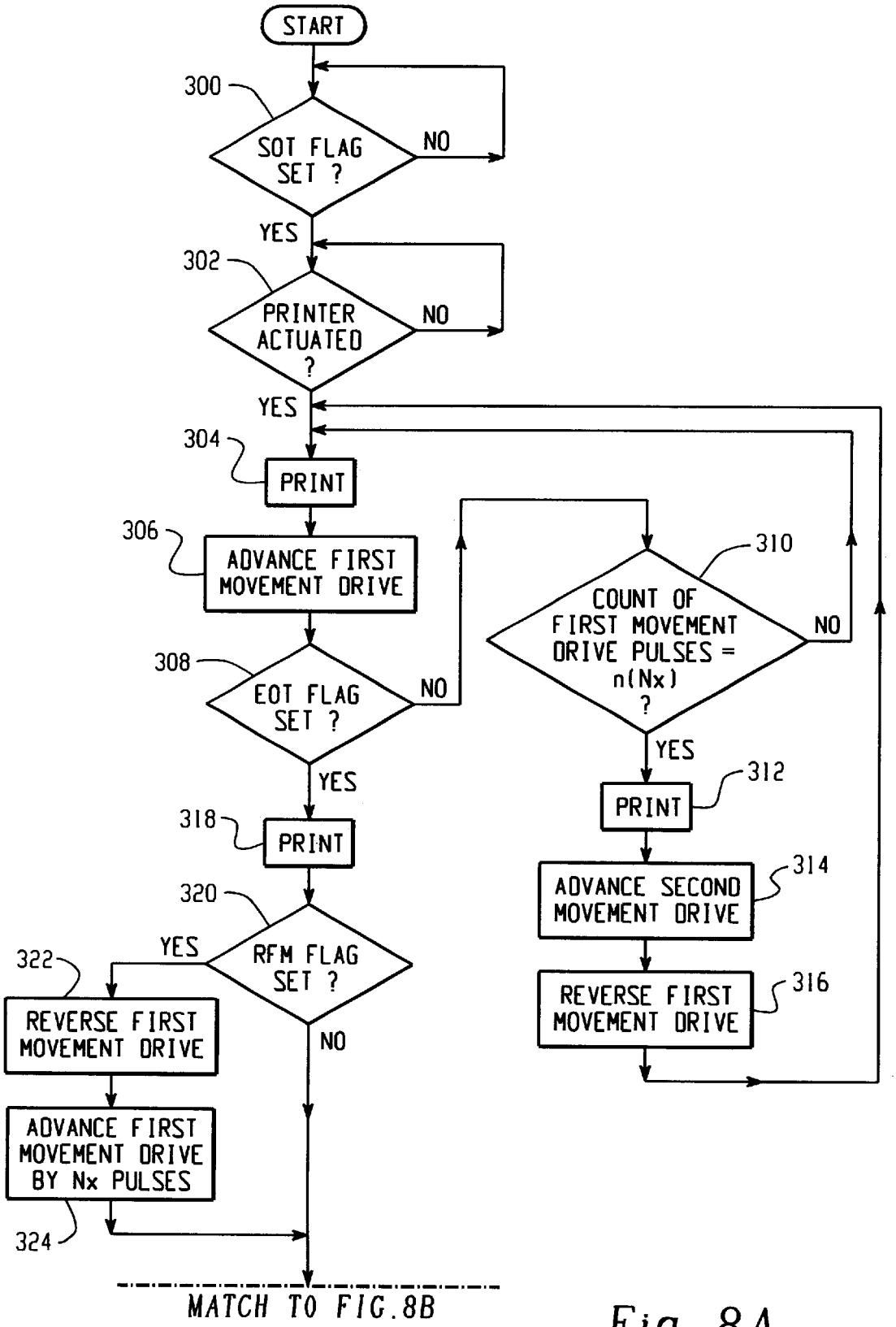
FIG. 8 is a flow chart of one exemplary control sequence for a printing operation in accordance with the invention for the embodiments described in FIGS. 6 & 7.
Figure 8B:
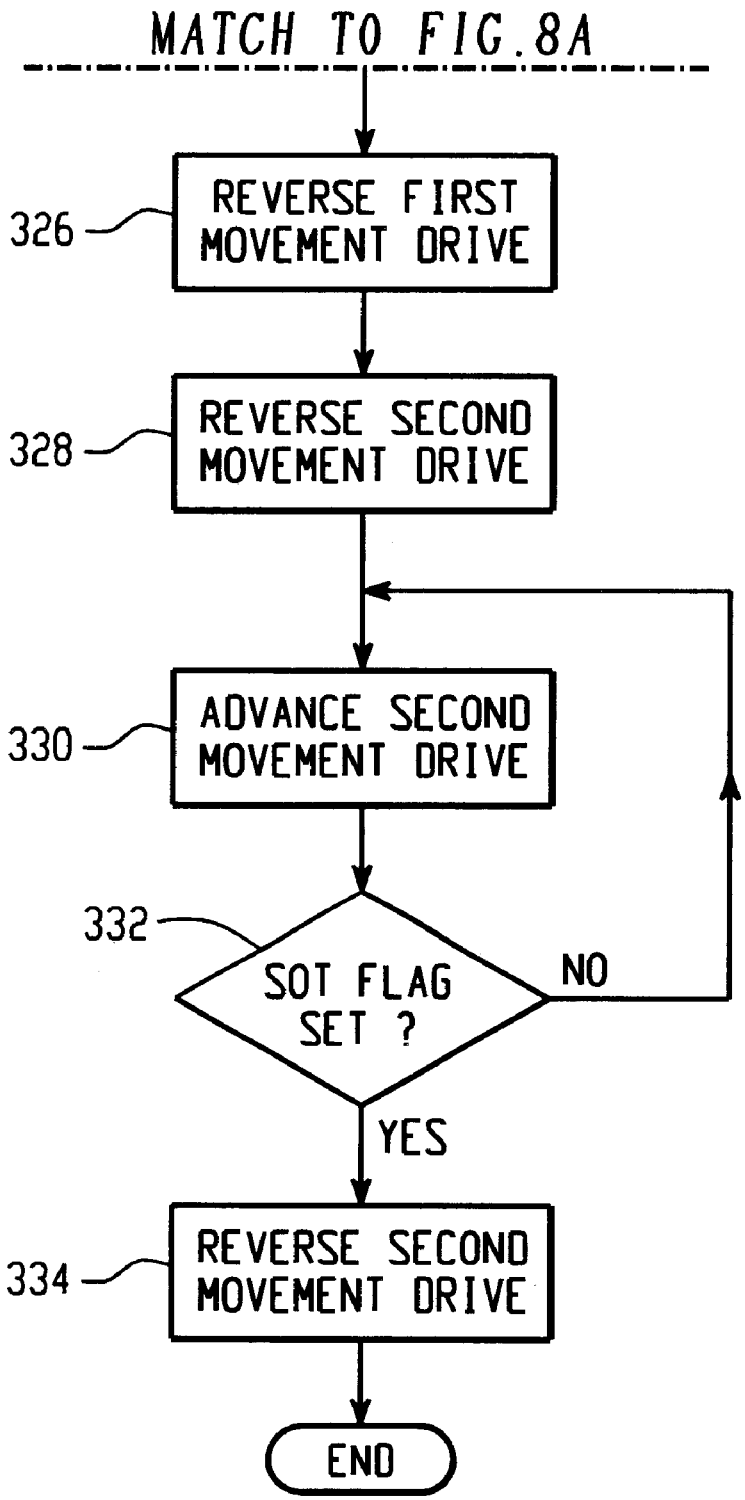

FIG. 8 is a flow chart of an exemplary control sequence for a printer having a bidirectional second movement drive as described in FIGS. 6 & 7. The control sequence is identical to that shown in FIG. 3, for a printer having a unidirectional second movement drive, through step 326. Whereas the sequence of FIG. 3 must end after step 326, the sequence of FIG. 8 continues from step 326 to 328, where the direction of the second movement drive is reversed. At step 330 the second movement drive is advanced, now in the reverse direction, without printing taking place. At step 332 the SOT flag is tested. If the SOT flag is not set, indicating that the mechanism has not been reset to the start (SOT) position, the control sequence loops back to 330 and drive continues until the SOT flag is set, indicating that the mechanism has been returned to the start position. The direction of the second movement drive is again reversed at step 334 to prepare the mechanism for the next print job.

The control sequence described in FIG. 8 provides a multiple path raster scanned printer in which the print head is automatically returned to the start position, or SOT, upon completion of a print sequence or job. A somewhat different approach is presented in FIG. 9, which shows the control sequence for a printer having a bidirectional second movement drive, but which does not return the print head to the start position when EOT is reached. Rather, upon completion of a print job, with the print head at the EOT position, that EOT position is taken to be the SOT position for the next print job. This of course requires that every alternate print image is produced backwards, starting at the end, but this is readily accommodated by the image generating software and print image processor. The finished print is of course normal, and the user is unaware that it was printed in reverse order.

Figure 9:
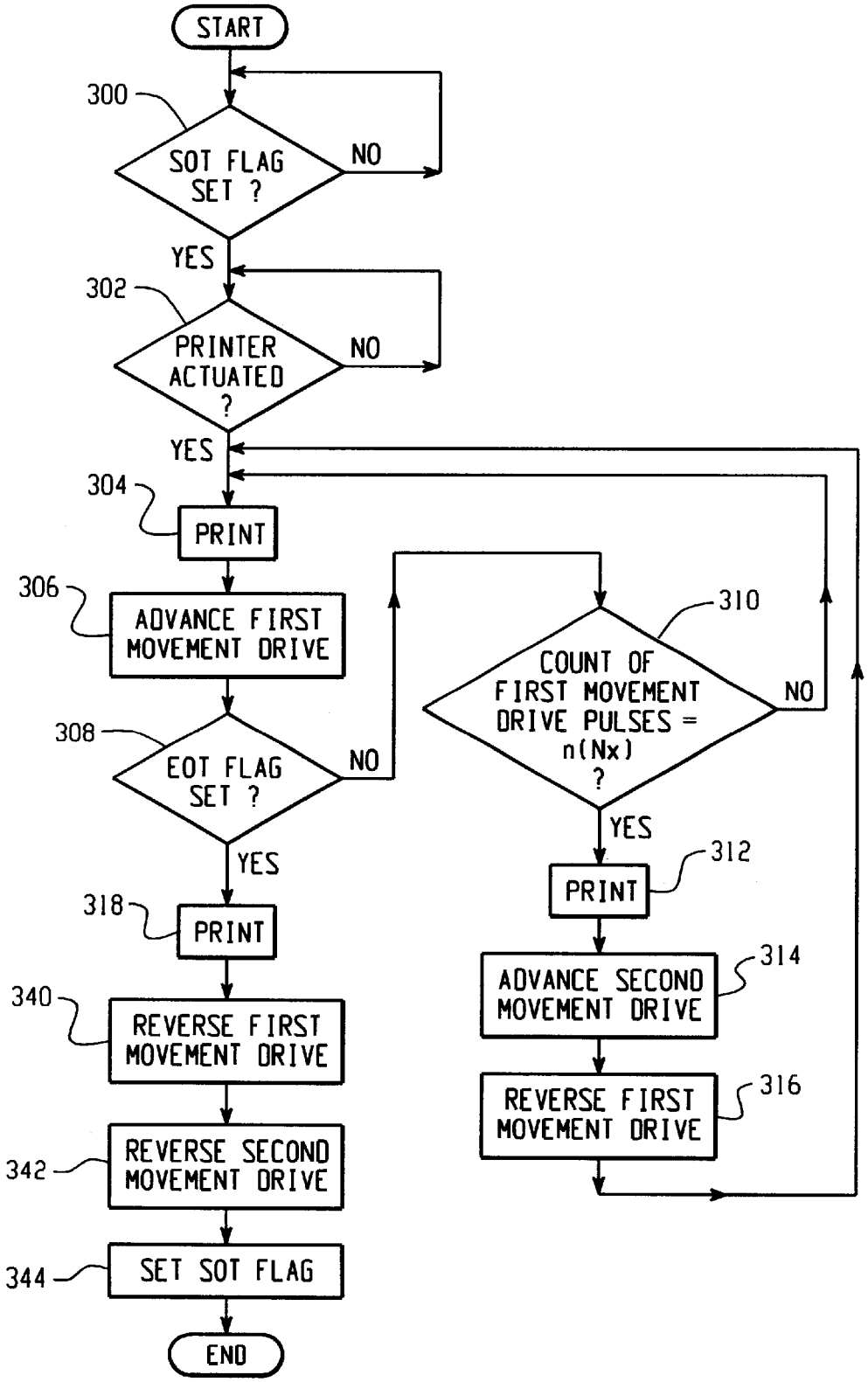
FIG. 9 is a flow chart of another exemplary control sequence for a printing operation in accordance with the invention for the embodiments described in FIGS. 6 & 7.

Referring to FIG. 9, it will be seen that control flow is the same as that of FIG. 3, through step 318, the final print step. At that point in FIG. 9, both the first and second movement drives are reversed at 340 & 342 respectively. At 344 the SOT flag is set to indicate that the print head is in the start position, even though the print head has not been physically moved from the EOT position. This flag enables a subsequent printing operation, in the reverse direction, and also serves as a signal to the print image processor (not shown) to generate the print image in reverse order.

Figure 10:
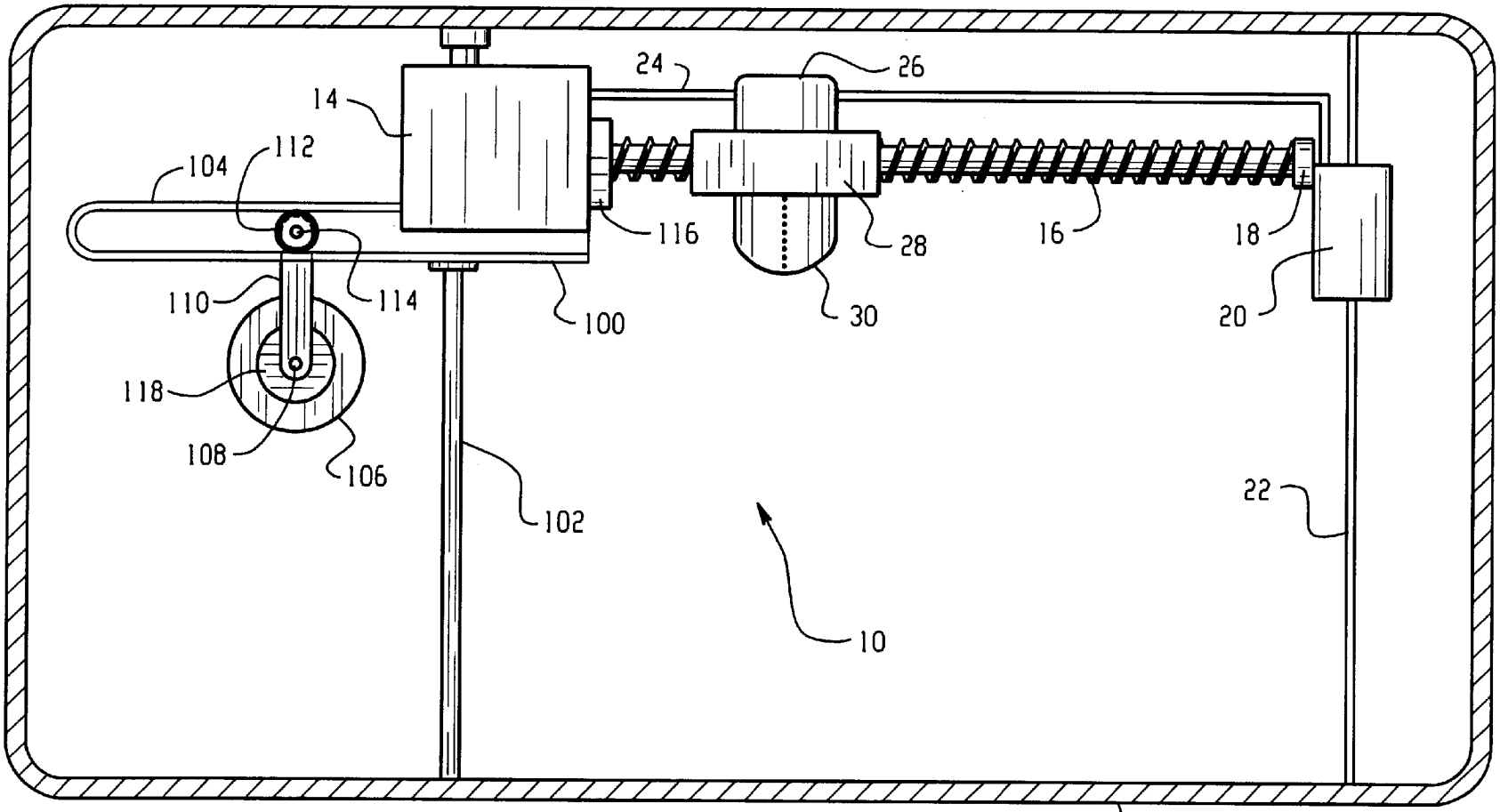
FIG. 10 is a simplified schematic of a multiple path raster scan printer mechanism incorporating a unidirectional motor drive coupled to a cyclically bidirectional drive mechanism.

FIG. 10 is a simplified schematic of a multiple path raster scan printer mechanism 10, mounted in a housing 12, incorporating a unidirectional motor drive coupled to a cyclically bidirectional drive mechanism. As in the printer mechanism of FIG. 1, a first movement drive comprising motor 14, lead screw 16, and nut 28 is used to drive a print head 30 back and forth along a support 24. In this case, however, the motor 14 is carried on a platform 100 which is slidably mounted on a support 102 while an encoder 116 produces pulses in response to rotation of the lead screw 16. The pulses are used by the control circuit as previously described to monitor the position of the print head along the lead screw. Platform 100 carries a slotted extension 104. A second motor 106 has its shaft 108 attached to arm 110, which in turn carries a roller 112 mounted to the arm 110 via pin 114. The roller 112 is a sliding fit in slotted extension 104, forming a scotch yoke mechanism which converts the rotary motion of motor shaft 108 to reciprocating motion. This reciprocating motion moves the platform 100, and therefore the entire first movement drive mechanism, along support 102. Encoder 118 produces pulses in response to the rotation of a motor shaft 108. These pulses are used by the control circuit to monitor the position of the first movement drive mechanism. Even though the motor 106 is driven in only a single direction, i.e. unidirectional motor drive, the scotch yoke mechanism will convert this unidirectional rotary motion to bidirectional reciprocating motion. While a particular mechanism has been shown for purposes of example, it will be recognized that there are many mechanisms which may be used for the purpose of converting unidirectional rotary motion to reciprocating motion. It will be further recognized and understood that the mechanism illustrated does not yield a uniform and linear transformation of rotary to linear motion. The amount of linear motion produced for a given angular rotation of the motor shaft will vary cyclically, but since this variation occurs in a known manner, compensation may be made by, for example, cyclically adjusting the number of drive pulses applied to the motor. That is, the linear advance of the platform 100 from one line of print to the next will always be of the same magnitude, but the number of drive pulses applied to motor 106 to obtain that advance will vary in a known manner.

While FIG. 10 illustrates the use of a unidirectional motor drive coupled to a cyclically bidirectional drive mechanism for the second movement drive, it will be recognized that such a drive mechanism may be applied to the first movement drive as well, and that both first and second movement drives may utilize such drive mechanisms.

Figure 11A:
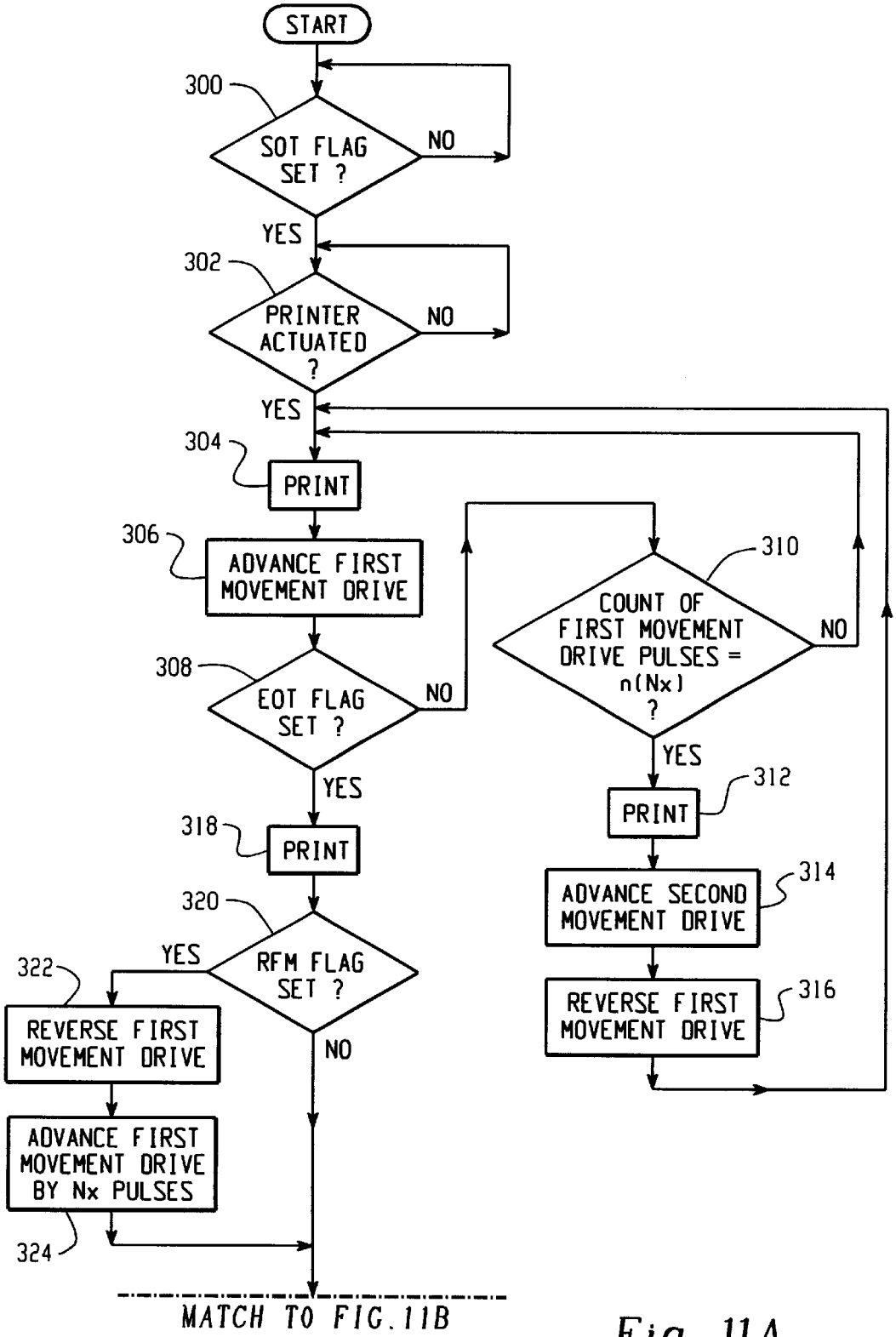
FIG. 11 is a flow chart of an exemplary control sequence for a printing operation in accordance with the invention for the embodiment described in FIG. 10.
Figure 11B:
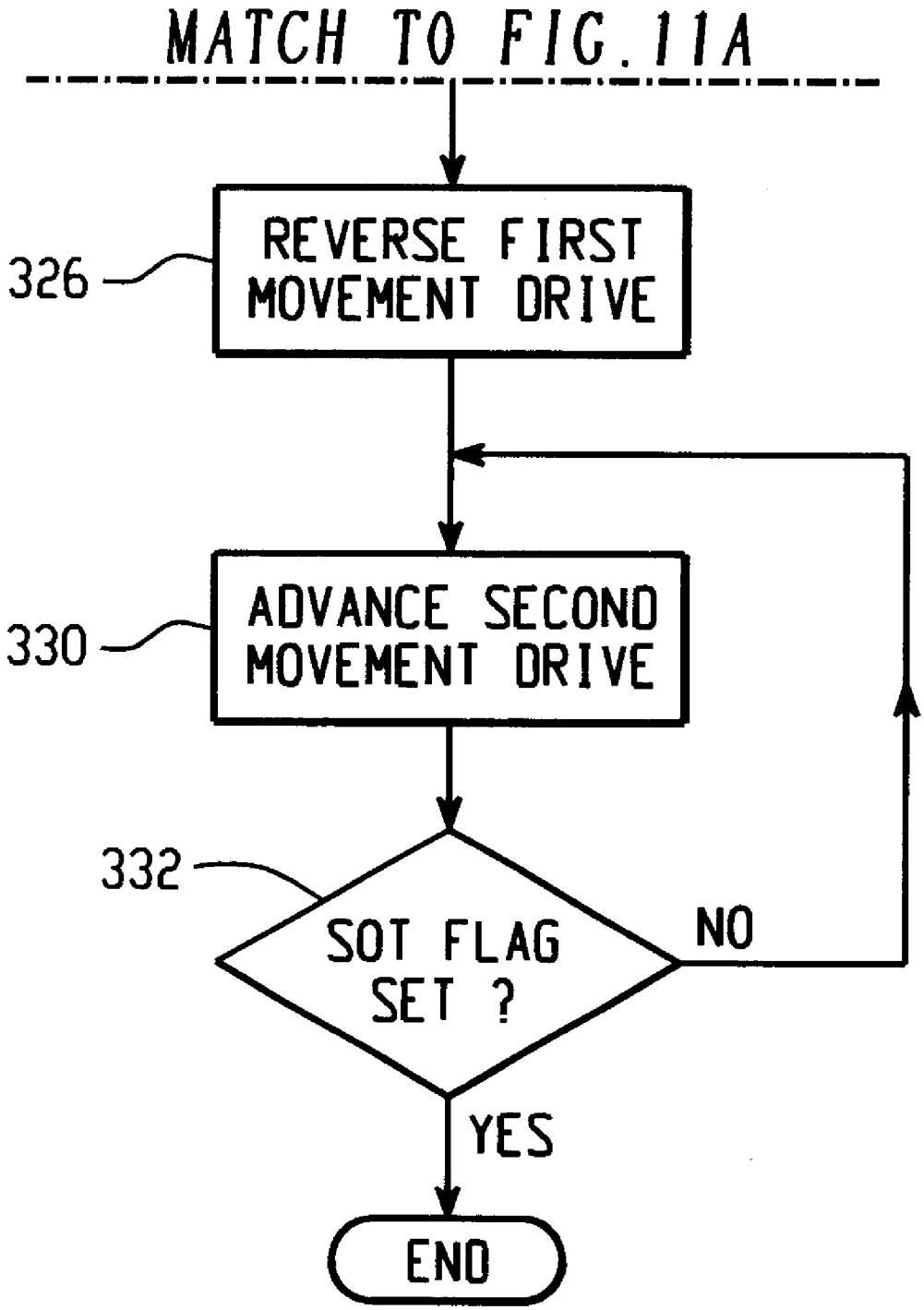

FIG. 11 is a flow chart of an exemplary control sequence for a printing operation in accordance with the invention for the embodiment described in FIG. 10. As in FIG. 8, FIG. 11 shows a control sequence which causes the printer to be reset to the start, or SOT, position upon completion of a printing operation. FIG. 11 is in fact identical to FIG. 8 through step 326, and differs thereafter only in the respect that steps 328 and 334, both identified as REVERSE SECOND MOVEMENT DRIVE, are omitted, because there is neither need nor provision for reversal of the second movement drive in the apparatus of FIG. 10. Referring to FIG. 11, the first movement drive is reversed at step 326, then, at 330, the second movement drive is advanced. The SOT flag is tested at 332, and the second movement drive is again advanced, the loop continuing until the SOT flag is found to be set, indicating that the printer has been reset to the start position as desired.

Figure 12:
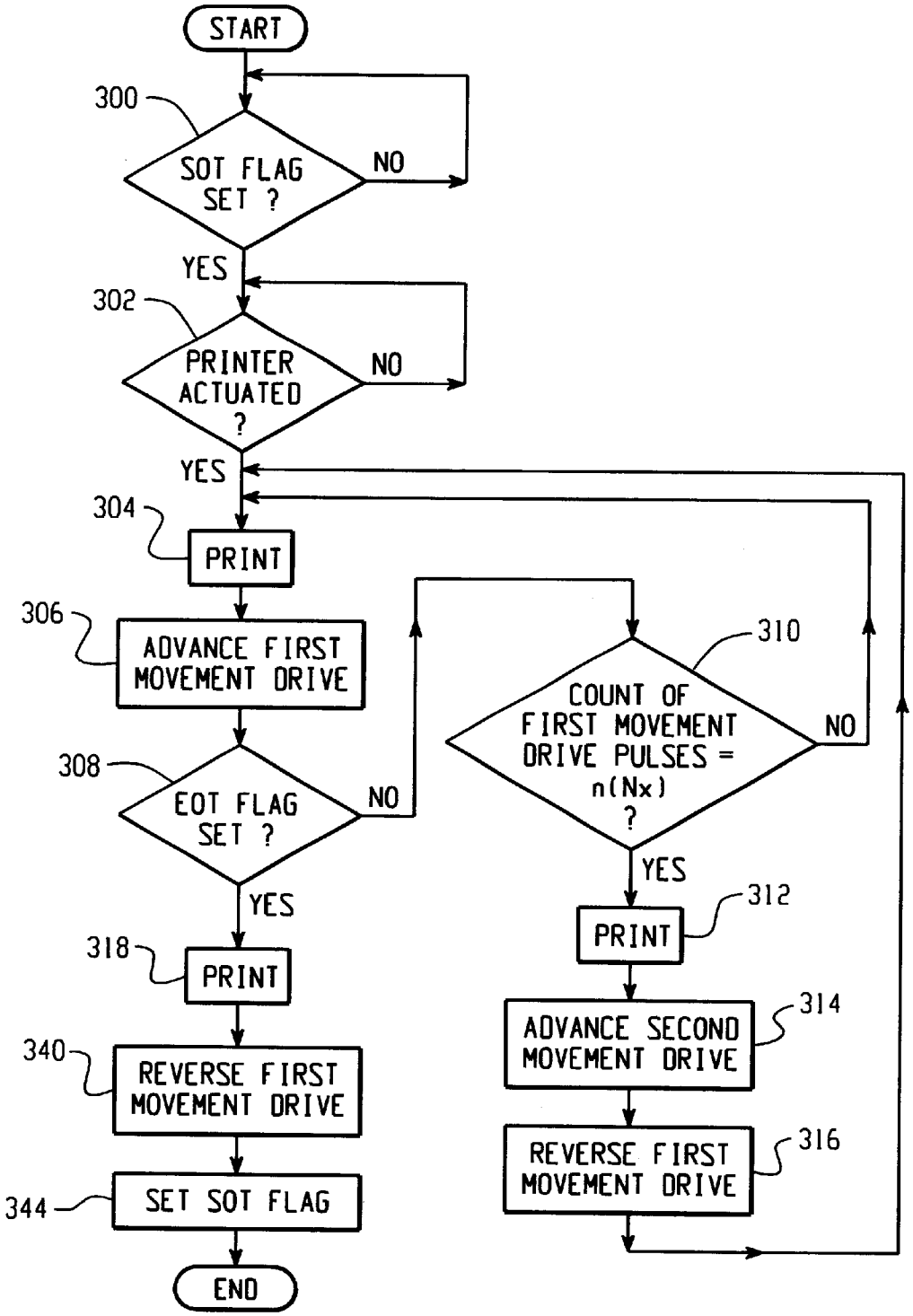
FIG. 12 is a flow chart of another exemplary control sequence for a printing operation in accordance with the invention for the embodiment described in FIG. 10.

FIG. 12 is a flow chart of another exemplary control sequence for a printing operation in accordance with the invention for the embodiment described in FIG. 10. As was shown in FIG. 9 for the embodiments of FIGS. 6 & 7, FIG. 12 describes a control sequence for the embodiment of FIG. 10, but which does not return the print head to the start position when EOT is reached. Rather, upon completion of a print job, with the print head at the EOT position, that EOT position is taken to be the SOT position for the next print job. FIG. 12 is identical to FIG. 9, but with step 342, REVERSE SECOND MOVEMENT DRIVE, deleted. Referring to FIG. 12, at step 340 the first movement drive is reversed, then at step 344 the SOT flag is set. There is neither need nor provision for a reversal of the second movement drive. The printer has now been reset, and is ready to print the next image using the EOT position of the previous print as the new SOT position, as was described previously with regard to FIG. 9.

It should be noted that the control flow charts described in FIGS. 3, 9, 11, & 12 show various steps as occurring sequentially, but in some cases this has been done for purposes of clarification only, and it will be recognized that some steps shown as sequential can in fact be carried out simultaneously. For example, when advances of both movement drives are called for, such advances may be executed sequentially, but it will be understood that such movements can also be beneficially carried out simultaneously.

While the invention has been shown and described with respect to specific embodiments thereof, this is for the purpose of illustration rather than limitation, and other variations and modifications of the specific embodiments herein shown and described will be apparent to those skilled in the art within the intended spirit and scope of the invention as set forth in the appended claims.

What is claimed is:

1. A printing device for printing text, indicia, and images on a medium, having a housing that abuts a surface of the medium during a printing sequence; a raster scan printing mechanism disposed in said housing for printing on the medium during a printing sequence including a print head which is moved from a starting position to an ending position along a plurality of paths during a printing sequence, a bidirectional first movement drive for movement of said print head along each of said paths, and a second movement drive for advance of the print head from path to path; control means disposed in said housing for controlling the printing device during a printing sequence including interface means to receive and interpret data and instructions from a host computer, and motion control means for executing said instructions;

characterized in that said second movement drive is bidirectional and in that said raster scan printing mechanism comprises reset means entirely disposed in said housing for autonomous placement of said print head in a starting position for a printing sequence; said reset means comprising tracking means for monitoring the position of the print head along each of said paths and from path to path, and means responsive to said tracking means for controlling said bidirectional first movement drive and said second bidirectional second movement drive for resetting said print head to a starting position.

2. The printing device of claim 1 wherein said bidirectional first movement drive comprises a bidirectional motor drive.

3. The printing device of claim 1 wherein said bidirectional first movement drive comprises a unidirectional motor drive and a cyclically bidirectional drive mechanism.

4. The printing device of claim 1 wherein said bidirectional second movement drive comprises a bidirectional motor drive.

5. The printing device of claim 4 wherein said bidirectional motor drive comprises a dc motor.

6. The printing device of claim 4 wherein said bidirectional motor drive comprises a stepper motor.

7. The printing device of claim 1 wherein said bidirectional second movement drive comprises a unidirectional motor drive and a cyclically bidirectional drive mechanism.

8. The printing device of claim 1 wherein said motion control means comprises means of counting pulses and comparing said counts to counts representing known positions.

9. The printing device of claim 8 wherein said pulses are stepper motor drive pulses.

10. The printing device of claim 8 wherein said pulses are position encoder output pulses.

11. The printing device of claim 8 wherein one of said known positions is the starting position.

12. The printing device of claim 8 wherein one of said known positions is the ending position.

13. The printing device of claim 1 wherein said control means executes a control sequence to operate said bidirectional first and second movement drives simultaneously during at least a portion of said printing sequence.

14. The printing device of claim 1 wherein said control means executes a control sequence to operate said bidirectional first and second movement drives sequentially during at least a portion of said printing sequence.

15. A printing device of claim 1 wherein said placement of the print head in a starting position for a printing sequence comprises physical movement of the print head at the beginning of said printing sequence.

16. The printing device of claim 1 wherein said placement of the print head in a starting position for a printing sequence comprises physical movement of the print head at the end of the previous printing sequence.

17. The printing device of claim 1 wherein said placement of the print head in a starting position for a printing sequence comprises physical movement of the print head during the previous printing sequence.

18. A printing device for printing text, indicia and images on a medium, having a housing that abuts a surface of the medium, during a printing sequence: a raster scan printing mechanism disposed in said housing for printing on the medium during a printing sequence including a print head which is moved from a starting position to an ending position along a plurality of paths during a printing sequence, a bidirectional first movement drive for bidirectional movement of said print head along each of said paths, and a second movement drive for advance of the print head from path to path; control means disposed in said housing for controlling the printing device during a printing sequence, including interface means to receive and interpret data and instructions from a host computer, and motion control means for executing said instructions;

characterized in that said second movement drive is bidirectional and in that said raster scan printing mechanism comprises reset means for moving said print head from an ending position to a starting position at the end of a printing sequence; said reset means comprising tracking means for monitoring the position of the print head, means responsive to said tracking means for controlling said bidirectional first movement drive, said bidirectional second movement drive comprising an unidirectional motor drive and a manually operable reset drive.

19. A printing device for printing text, indicia, and images on a medium, having a housing that abuts a surface of the medium during a printing sequence; a raster scan printing mechanism disposed in said housing for printing on the medium during a printing sequence including a print head which is moved from a starting position to an ending position along a plurality of paths during a printing sequence, a bidirectional first movement drive for bidirectional movement of said print head along each of said paths, and a second movement drive for advance of the print head from path to path; control means disposed in said housing for controlling the printing device during a printing sequence, including interface means to receive and interpret data and instructions from a host computer, and motion control means for executing said instructions;

characterized in that said second movement drive is bidirectional and in that said raster scan printing mechanism comprises reset means for moving said print head from an ending position to a starting position at the end of a printing sequence; said reset means comprising tracking means for monitoring the position of the print head, means responsive to said tracking means for controlling said bidirectional first movement drive, said bidirectional second movement drive comprising an unidirectional motor drive and a manually actuated reset drive including a storage element whereby energy stored in said storage element during a printing sequence motivates said reset drive.

20. The printing device of claim 19 wherein said storage element is a spring.

* * * * *